US006244209B1

(12) United States Patent
Aguiar

(10) Patent No.: US 6,244,209 B1
(45) Date of Patent: Jun. 12, 2001

(54) SIGNAL BALLOON

(76) Inventor: Ronald Aguiar, 6828 Birchwood Cir., Citrus Heights, CA (US) 95621

( * ) Notice: Subject to any disclaimer, the term of this patent is extended or adjusted under 35 U.S.C. 154(b) by 0 days.

(21) Appl. No.: 09/296,316

(22) Filed: Apr. 22, 1999

(51) Int. Cl.[7] ..... G09F 21/06
(52) U.S. Cl. ..... 116/210; 116/DIG. 9
(58) Field of Search ..... 116/210, DIG. 8, 116/DIG. 9, DIG. 7

(56) References Cited

U.S. PATENT DOCUMENTS 3,310,024 * 3/1967 McConnell ..... 116/210
3,727,229 * 4/1973 Clinger et al. ..... 116/210
4,044,711 * 8/1977 Jamison ..... 116/210
4,944,242 * 7/1990 Russell ..... 116/210
5,020,467 * 6/1991 Van Patten ..... 116/210
5,095,845 * 3/1992 Murphy ..... 116/210

* cited by examiner

*Primary Examiner*—Andrew H. Hirshfeld

(57) ABSTRACT

A signal balloon for providing a portable assembly to launch a signal balloon to indicate the location of the user to others. The signal balloon includes a case having a top that can be opened. A spool is rotatably mounted in the case. An elongate flexible element is wound around the spool. A container is disposed in the case and coupled to an end of the flexible element. An inflatable balloon is disposed in the case and coupled to the container such that the balloon is in fluid communication with the container. A check valve is interposed between the balloon and the container.

1 Claim, 2 Drawing Sheets

SIGNAL BALLOON

BACKGROUND OF THE INVENTION

1. Field of the Invention

The present invention relates to signal balloons and more particularly pertains to a new signal balloon for providing a portable assembly to launch a signal balloon to indicate the location of the user to others.

2. Description of the Prior Art

The use of signal balloons is known in the prior art. More specifically, signal balloons heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,646,019; 3,002,490; 3,721,983; 2,831,967; 3,941,079; and U.S. Pat. No. Des. 332,578.

While these devices fulfill their respective, particular objectives and requirements, the aforementioned patents do not disclose a new signal balloon. The inventive device includes a case having an open top. A spool is rotatably mounted in the case. An elongate flexible element is wound around the spool. A container is disposed in the case and coupled to an end of the flexible element. An inflatable balloon is disposed in the case and coupled to the container such that the balloon is in fluid communication with the container. A check valve is interposed between the balloon and the container.

In these respects, the signal balloon according to the present invention substantially departs from the conventional concepts and designs of the prior art, and in so doing provides an apparatus primarily developed for the purpose of providing a portable assembly to launch a signal balloon to indicate the location of the user to others.

SUMMARY OF THE INVENTION

In view of the foregoing disadvantages inherent in the known types of signal balloons now present in the prior art, the present invention provides a new signal balloon construction wherein the same can be utilized for providing a portable assembly to launch a signal balloon to indicate the location of the user to others.

The general purpose of the present invention, which will be described subsequently in greater detail, is to provide a new signal balloon apparatus and method which has many of the advantages of the signal balloons mentioned heretofore and many novel features that result in a new signal balloon which is not anticipated, rendered obvious, suggested, or even implied by any of the prior art signal balloons, either alone or in any combination thereof.

To attain this, the present invention generally comprises a case having a top that can be opened. A spool is rotatably mounted in the case. An elongate flexible element is wound around the spool. A container is disposed in the case and coupled to an end of the flexible element . An inflatable balloon is disposed in the case and coupled to the container such that the balloon is in fluid communication with the container. A check valve is interposed between the balloon and the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new signal balloon apparatus and method which has many of the advantages of the signal balloons mentioned heretofore and many novel features that result in a new signal balloon which is not anticipated, rendered obvious, suggested, or even implied by any of the prior art signal balloons, either alone or in any combination thereof.

It is another object of the present invention to provide a new signal balloon which may be easily and efficiently manufactured and marketed.

It is a further object of the present invention to provide a new signal balloon which is of a durable and reliable construction.

An even further object of the present invention is to provide a new signal balloon which is susceptible of a low cost of manufacture with regard to both materials and labor, and which accordingly is then susceptible of low prices of sale to the consuming public, thereby making such signal balloon economically available to the buying public.

Still yet another object of the present invention is to provide a new signal balloon which provides in the apparatuses and methods of the prior art some of the advantages thereof, while simultaneously overcoming some of the disadvantages normally associated therewith.

Still another object of the present invention is to provide a new signal balloon for providing a portable assembly to launch a signal balloon to indicate the location of the user to others.

Yet another object of the present invention is to provide a new signal balloon which includes a case having an open top. A spool is rotatably mounted in the case. An elongate flexible element is wound around the spool. A container is disposed in the case and coupled to an end of the flexible element. An inflatable balloon is disposed in the case and coupled to the container such that the balloon is in fluid communication with the container. A check valve is interposed between the balloon and the container.

Still yet another object of the present invention is to provide a new signal balloon that is able to attached to the belt of a user for easy carrying.

Even still another object of the present invention is to provide a new signal balloon that is easy to inflate and launch so that the assembly may be used by injured and partially incapacitated users.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
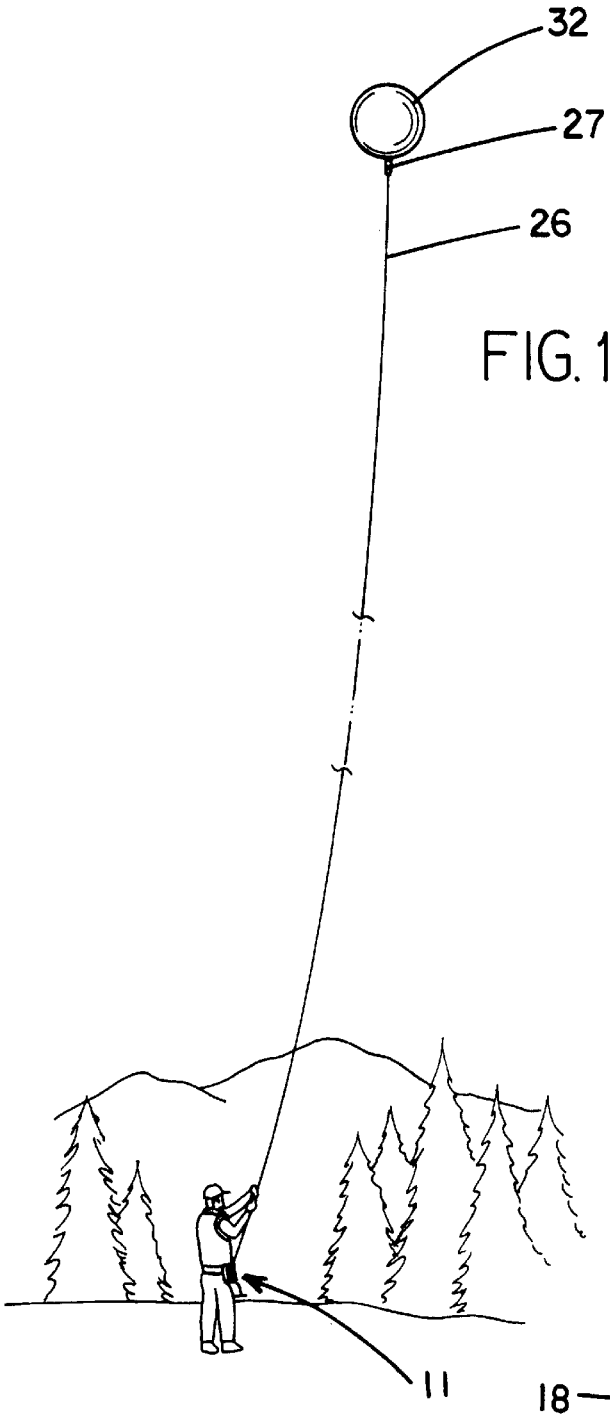
FIG. 1 is a schematic side view of a new signal balloon in use being inflated and floating above a user according to the present invention.
Figure 2:
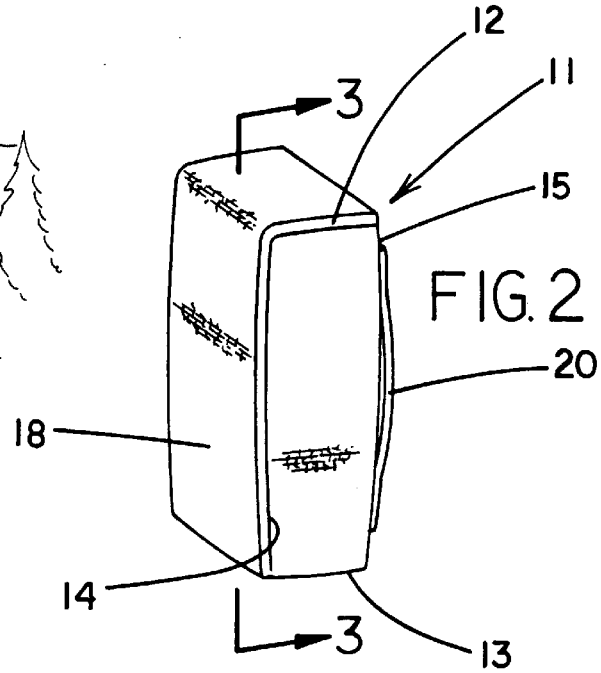
FIG. 2 is a schematic perspective view of the case with the cover flap attached thereto.

With reference now to the drawings, and in particular to FIGS. 1 through 4 thereof, a new signal balloon embodying the principles and concepts of the present invention and generally designated by the reference numeral 10 will be described.

As best illustrated in FIGS. 1 through 4, the signal balloon 10 generally comprises a case having an open top. A spool is rotatably mounted in the case. An elongate flexible element is wound around the spool. A container is disposed in the case and coupled to an end of the flexible element. An inflatable balloon is disposed in the case and coupled to the container such that the balloon is in fluid communication with the container. A check valve is interposed between the balloon and the container.

Figure 3:
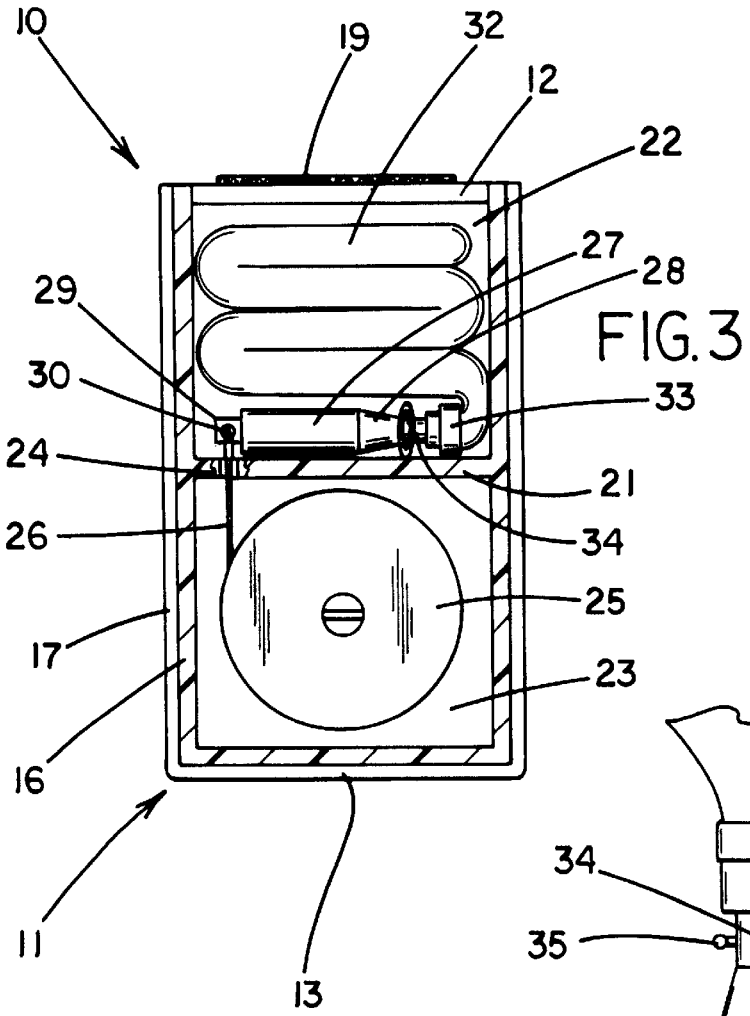
FIG. 3 is a schematic cross sectional view of the present invention taken from line 3—3 of FIG. 2 with the cover flap detached from the case.
Figure 4:
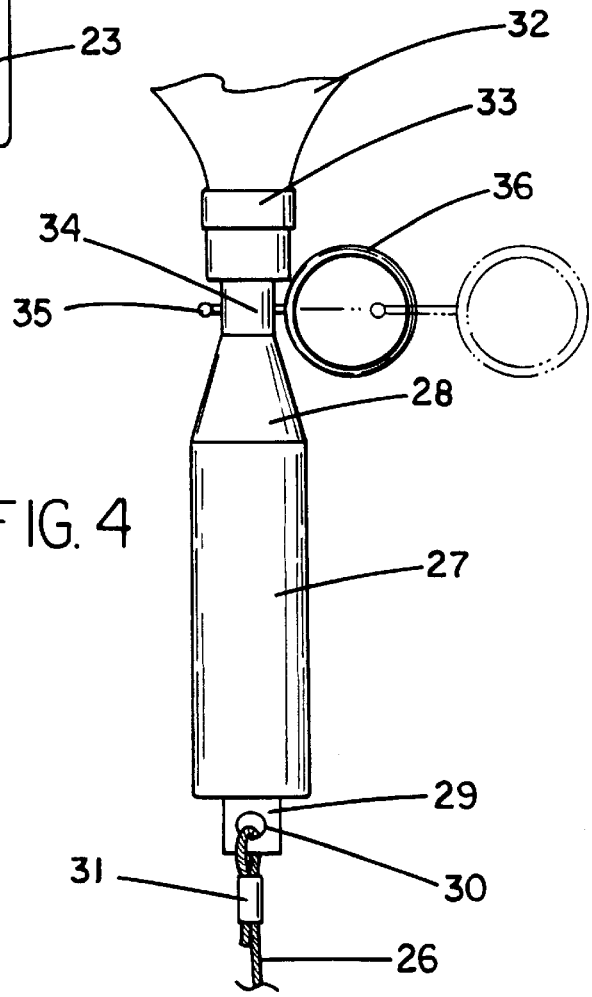
FIG. 4 is a schematic partial side view of the present invention.

In closer detail, the signal balloon 10 is an assembly that comprises a case 11 having a generally rectangular box shaped configuration, a top 12 that can be opened, a bottom 13, a front 14, and a back 15. Preferably, the open top and bottom of the case lie in substantially parallel planes with one another and the front and back of the case lie in substantially parallel planes with one another. With reference to FIG. 3, the case preferably comprises a rigid plastic material inner case 16 and a flexible fabric material outer case 17 substantially covering the inner case of the case.

The case has a removable flexible cover flap 18 substantially covering the top and front of the case. The cover flap is detachably attached to the case adjacent the top of the case. Ideally, a hook and loop fastener 19 detachably attaches the cover flap to the case adjacent the open top of the case.

Also present in the preferred embodiment is a belt loop 20 coupled to the back of the case. The belt loop is designed for extending a user's belt therethrough to secure the case to the user's belt.

The case has a dividing panel 21 therein located between the open top and bottom of the case which divides the interior of the case into top and bottom compartments 22,23 as best shown in FIG. 3. Ideally, the dividing panel is equidistantly positioned between the open top and bottom of the case so that the top and bottom compartments are substantially equal in area. The dividing panel has a hole 24 therethrough to provide a passage between the top and bottom compartments.

A spool 25 is rotatably mounted in the bottom compartment of the case to permit free rotation about an axis extending between the front and back of the case. The axis of rotation of the spool is preferably extended substantially perpendicular to the planes of the front and back of the case. An elongate flexible element 26 (such as a nylon cord or cable) is provided having a pair of opposite ends. A first end of the pair of ends of the flexible element is wound around and coupled to the spool such that rotation of the spool in a first direction further winds the flexible element around the spool and rotation of the spool in a second direction opposite the first direction unwinds the flexible element from around the spool. A second end of the pair of ends of the flexible element is extended through the hole of the dividing panel into the top compartment.

A generally cylindrical container is 27 disposed in the top compartment of the case. The container has a volume of compressed helium therein. The container has a pair of opposite ends with a generally frusta-conical portion 28 adjacent a first end of the pair of ends of the container. The frusta-conical portion of the container tapers towards the first end of the container for helping to reduce the profile of the container at the first end of the container.

The container has an attachment tab 29 outwardly extending from a second end of the pair of ends of the container. The attachment tab has an attachment hole 30 therethrough. The second end of the flexible element is extended through the attachment hole to couple the second end of the flexible element to the second end of the container. Ideally, a fastener 31 is wrapped around the second end of the flexible element and an adjacent portion of the flexible element to secure the flexible element to the attachment tab.

A folded inflatable balloon 32 is disposed in the top compartment of the case. The balloon has a mouth opening 33 coupled to the first end of the container to fluidly connect the balloon to the interior of the container such that the compressed helium in the container may pass into the balloon to inflate the balloon.

A check valve 34 is interposed between the mouth of the balloon and the first end of the container. The check valve has a removable release pin 35 with a pull ring 36 coupled thereto. In use, the check valve closes fluid communication between the container and the balloon when the release pin is in the check valve. Removing of the release pin permits passage through the check valve of gas from the container into the balloon. After the pin has been pulled, the check valve is designed to prohibit passage of gas from the balloon back into the container.

In an ideal illustrative embodiment the balloon has a highly visible red or orange exterior surface to make it easier to see a long distance away. In the ideal illustrative embodiment, the balloon has an outer diameter of about 2½ feet when fully inflated with the helium gas in the container and the flexible element has a length of about 100 feet to permit floating of the balloon high enough above the user to be seen a long distance away and above the tree tops when in a forest. In the ideal illustrative embodiment, Ideally, the container has a length between the ends of the container of about 4 inches and a diameter of about 2 inches and the case has a length between the open top and bottom of the case of between about 6 inches and about 8 inches and a width of about 4 inches.

In use, a user first removes the cover flap to expose the open top of the case. The user then removes the folded balloon and container out of the case thereby pulling therewith more and more of the flexible element out of the case. The user pulls on the pull ring to remove the release pin to open the passage between the container and the balloon to permit the inflating of the balloon with the helium gas in the container. As the balloon is inflated, it rises into the air unwinding more and more of the flexible element from about the spool so that the flexible element rises with the balloon to an elevation where the balloon is sufficiently high enough to be spotted a distance away from the user to thereby provide a visual indicator to others trying to locate the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A signal balloon assembly, comprising:

a case having a generally rectangular box shaped configuration, a top being openable, a bottom, a front, and a back;

said top and bottom of said case lying in substantially parallel planes with one another;

said front and back of said case lying in substantially parallel planes with one another;

said case comprising a rigid inner case and a flexible outer case substantially covering said inner case of said case;

said case having a removable flexible cover flap substantially covering said top and said front of said case;

a hook and loop fastener detachably attaching said cover flap to said case adjacent said top of said case;

said case having a belt loop coupled to said back of said case, said belt loop being adapted for extending a user's belt therethrough to secure said case to the user's belt;

said case having a dividing panel therein located between said open top and bottom of said case, said dividing panel dividing said case into top and bottom compartments;

wherein said dividing panel is equidistantly positioned between said top and bottom of said case such that said top and bottom compartments are substantially equal in area;

said dividing panel having a hole therethrough for providing a passage between said to and bottom compartments;

a spool being rotatably mounted in said bottom compartment of said case to permit free rotation about an axis extending between said front and back of said case;

said axis of rotation of said spool being extended substantially perpendicular to said planes of said front and back of said case;

an elongate flexible element having a pair of opposite ends, a first end of said pair of ends of said flexible element being wound around said spool such that rotation of said spool in a first direction further winds said flexible element around said spool and rotation of said spool in a second direction opposite said first direction unwinds said flexible element from around said spool;

a second end of said pair of ends of said flexible element being extended through said hole of said dividing panel into said top compartment;

a generally cylindrical container being disposed in said top compartment of said case;

said container having a volume of compress helium therein;

said container having a pair of opposite ends, said container having a generally frusta-conical portion adjacent a first end of said pair of ends of said container;

said frusta-conical portion of said container tapering towards said first end of said container for helping to reduce said profile of said container at said first end of said container;

said container having an attachment tab outwardly extending from a second end of said pair of ends of said container, said attachment tab having an attachment hole therethrough;

said second end of said flexible element being extended through said attachment hole to couple said second end of said flexible element to said second end of said container;

wherein a fastener is wrapped around said second end of said flexible element and an adjacent portion of said flexible element is for securing said flexible element to said attachment tab;

an inflatable balloon being disposed in said top compartment of said case, said balloon having a mouth coupled to said first end of said container to fluidly connect said balloon to said interior of said container such that said compressed helium in said container may pass into said balloon to inflate said balloon;

a check valve being interposed between said mouth of said balloon and said first end of said container, said check valve having a removable release pin, said release pin having a pull ring coupled thereto;

said check valve closing fluid communication between said container and said balloon when said release pin is in said check valve, wherein removing of said release pin permits passage through said check valve of gas from said container into said balloon, wherein said check valve prohibits passage of gas from said balloon back into said container;

wherein said balloon has a highly visible exterior surface;

wherein said balloon has an outer diameter of about 2½ feet when fully inflated with said helium gas in said container;

wherein said flexible element has a length of about 100 feet for permitting floating of said balloon high enough above the user to be seen from a distance;

wherein said container has a length between said ends of said container of about 4 inches and a diameter of about 2 inches; and wherein said case has a length between said open top and bottom of said case of between about 6 inches and about 8 inches and a width of about 4 inches.

* * * * *